US010169997B2

(12) United States Patent
Kato et al.

(10) Patent No.: US 10,169,997 B2
(45) Date of Patent: Jan. 1, 2019

(54) VEHICLE ALERT APPARATUS

(71) Applicant: Toyota Jidosha Kabushiki Kaisha, Toyota-shi, Aichi-ken (JP)

(72) Inventors: Mitsuharu Kato, Kasugai (JP); Yohei Fujii, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 15/976,377

(22) Filed: May 10, 2018

(65) Prior Publication Data

US 2018/0261096 A1 Sep. 13, 2018

Related U.S. Application Data

(63) Continuation of application No. 15/463,759, filed on Mar. 20, 2017, now Pat. No. 9,997,073.

(30) Foreign Application Priority Data

Mar. 23, 2016 (JP) ..... 2016-058209

(51) Int. Cl.
*G08G 1/16* (2006.01)

(52) U.S. Cl.
CPC ..... *G08G 1/162* (2013.01); *G08G 1/166* (2013.01)

(58) Field of Classification Search
CPC ..... B25B 7/02; B25B 27/14; H01R 43/26; H01R 2201/26; B25G 1/102; B25G 1/12
USPC ..... 340/903
See application file for complete search history.

(56) References Cited

U.S. PATENT DOCUMENTS

2013/0226408 A1* 8/2013 Fung ..... B60W 40/09 701/41
2013/0253816 A1* 9/2013 Caminiti ..... G08G 1/0104 701/301
2016/0280134 A1* 9/2016 Miura ..... B60Q 9/008
2017/0278398 A1 9/2017 Kato et al.

FOREIGN PATENT DOCUMENTS

JP 5673476 B2 2/2015

* cited by examiner

*Primary Examiner* — Tanmay Shah
(74) *Attorney, Agent, or Firm* — Dinsmore & Shohl LLP

(57) ABSTRACT

An alert ECU acquires intersection information representing a situation of an intersection (target intersection) where a host vehicle will enter. The alert ECU excludes the leftward and rightward orientations from assistance-target orientations when the target intersection is grade separated, when a traffic light is installed at the target intersection, when a median strip is installed in the target intersection along the host vehicle traveling direction, or when a stop sign is not installed at the target intersection. As a result, an alert to a driver for a target vehicle is inhibited when the target vehicle is approaching the host vehicle from an orientation in which it is estimated that the target vehicle cannot collide with the host vehicle and when the target vehicle is approaching the host vehicle from an orientation in which it is estimated that the target vehicle will not collide with the host vehicle for regulatory reasons.

13 Claims, 10 Drawing Sheets

VEHICLE ALERT APPARATUS

CROSS-REFERENCE TO RELATED APPLICATIONS

This application is a continuation application of U.S. patent application Ser. No. 15/463,759 filed Mar. 20, 2017 which claims priority to Japanese Patent Application No. 2016-058209 filed on Mar. 23, 2016 which are incorporated herein by reference in its entirety including the specification, drawings and abstract.

BACKGROUND

1. Technical Field

The present disclosure relates to a vehicle alert apparatus that alerts the driver when another vehicle that may collide with the host vehicle is detected

2. Description of Related Art

Conventionally, as proposed in Japanese Patent No. 5673476, a vehicle alert apparatus is known that carries out vehicle-vehicle communication with other vehicles around the host vehicle to determine the approaching state between the host vehicle and another vehicle and, when another vehicle that may collide with the host vehicle is detected, alerts the driver.

SUMMARY

Such a vehicle alert apparatus using vehicle-vehicle communication detects another vehicle that is approaching the host vehicle, based on the information sent from the other vehicle (absolute position of the other vehicle, absolute orientation in which the vehicle body is facing, vehicle speed, etc.). Therefore, even in a situation in which the other vehicle will not actually collide with the host vehicle, an alert is given to the driver simply because another vehicle is approaching the host vehicle. For example, as shown in FIG. 11, when the traveling road of the host vehicle A and another road are grade separated, the host vehicle A cannot collide with the other vehicle B traveling on the road that is grade separated from the traveling path of the vehicle A. Even in such a case, the conventional vehicle alert apparatus gives an alert just because the other vehicle is approaching the host vehicle. Such an unnecessary alert makes the driver feel annoyed and, in addition, decreases the reliability of the vehicle alert apparatus.

The present disclosure reduces the frequency with which unnecessary alerts are given.

A first aspect of the present disclosure relates to a vehicle alert apparatus including a target vehicle detection device configured to carry out vehicle-vehicle communication with another vehicle around a host vehicle to determine an approaching state between the host vehicle and the other vehicle when the host vehicle is going to enter an intersection and, based on the approaching state, to detect another vehicle that may collide with the host vehicle as an alert target vehicle, an alert device configured to operate an alert unit to make a driver pay attention to the target vehicle when the target vehicle is detected, an intersection information acquisition device configured to acquire intersection information that represents a situation of an intersection where the host vehicle is going to enter, and an operation limitation device configured to inhibit an operation of the alert device for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information.

In the vehicle alert apparatus described above, the target vehicle detection device carries out vehicle-vehicle communication with another vehicle around the host vehicle to determine the approaching state between the host vehicle and the other vehicle when the host vehicle is going to enter an intersection and, based on the approaching state, detects another vehicle that may collide with the host vehicle as an alert target vehicle. When the target vehicle is detected, the alert device operates the alert unit to make the driver pay attention to the target vehicle.

An unnecessary alert, if issued, makes the driver feel annoyed. In view of this, the intersection information acquisition device acquires the intersection information representing the situation of the intersection where the host vehicle is going to enter. Based on the acquired intersection information, the operation limitation device inhibits the operation of the alert device for the target vehicle in at least one of the following two cases: one is the case in which the target vehicle is approaching the host vehicle from the orientation in which it is estimated that the target vehicle cannot collide with the host vehicle based on the intersection information and the other is the case in which the target vehicle is approaching the host vehicle from the orientation in which it is estimated that the target vehicle will not collide with the host vehicle for regulatory reasons based on the intersection information.

Therefore, if the target vehicle is approaching the host vehicle but if it is estimated that the target vehicle will not actually collide with the host vehicle, an alert to the driver is not given. Doing so reduces the frequency with which unnecessary alerts are given. As a result, this prevents the driver from feeling annoyed and, in addition, improves the reliability of the vehicle alert apparatus.

The intersection information acquisition device may be configured to acquire, as the intersection information, intersection information that represents a situation of the intersection including a grade separated location, where the host vehicle traveling road and another road are grade separated and that can be used to estimate whether the intersection is the grade separated location. The operation limitation device may be configured to determine that each of a leftward orientation and a rightward orientation of the host vehicle is an orientation in which the target vehicle cannot collide with the host vehicle and to inhibit the operation of the alert device for the target vehicle that is approaching the host vehicle from that orientation, if it is estimated that the intersection is the grade separated location.

When the roads are grade separated, neither the other vehicle will collide with the host vehicle nor will the host vehicle turn right or left. In view of this, the intersection information acquisition device acquires, as the intersection information, intersection information that represents the situation of the intersection including the grade separated location, where the host vehicle traveling road and the other road are grade separated and that can be used to estimate whether the intersection is the grade separated location. As a result, if it is estimated that the intersection is a grade separated intersection, the operation limitation device determines that each of the leftward orientation and the rightward orientation of the host vehicle is an orientation in which the target vehicle cannot collide with the host vehicle, and inhibits the operation of the alert device for the target vehicle that is approaching the host vehicle from that orientation. Therefore, the alerts to the driver can be limited properly.

The intersection information acquisition device may be configured to acquire, as the intersection information, information that can be used to estimate the presence or absence of a median strip in the intersection. The operation limitation device may be configured to set the orientation in which it is estimated that the target vehicle cannot collide with the host vehicle based on a median strip direction with respect to the host vehicle and to inhibit the operation of the alert device for the target vehicle that is approaching the host vehicle from the set orientation, if it is estimated that the median strip is provided in the intersection.

When the median strip is provided in the intersection, it is possible to determine whether the other vehicle may collide with the host vehicle according to the median strip direction. In view of this, the intersection information acquisition device acquires the information that can be used to estimate whether there is the median strip in the intersection. As a result, if it is estimated that the median strip is provided in the intersection, the operation limitation device sets the orientation in which it is estimated that the target vehicle cannot collide with the host vehicle based on the median strip direction with respect to the host vehicle, and inhibits the operation of the alert device for the target vehicle that is approaching the host vehicle from the set orientation.

The intersection information acquisition device may be configured to acquire, as the intersection information, information that can be used to estimate whether a traffic light is installed at the intersection. The operation limitation device may be configured to determine that each of a leftward orientation and a rightward orientation of the host vehicle is an orientation in which it is estimated that the target vehicle will not collide with the host vehicle for regulatory reasons and to inhibit the operation of the alert device for the target vehicle that is approaching the host vehicle from that orientation, if it is estimated that the traffic light is installed at the intersection.

At the intersection at which the traffic light is installed, it is estimated that the other vehicle will not collide with the host vehicle assuming that the drivers conform to the regulations. In view of this, the intersection information acquisition device acquires the information that can be used to estimate whether the traffic light is installed at the intersection. As a result, if it is estimated that the traffic light is installed at the intersection, the operation limitation device determines that each of the leftward orientation and the rightward orientation of the host vehicle is an orientation in which it is estimated that the target vehicle will not collide with the host vehicle for regulatory reasons and inhibits the operation of the alert device for the target vehicle that is approaching the host vehicle from that orientation. Therefore, the alerts to the driver can be limited properly.

The intersection information acquisition device may be configured to acquire information that can be used to estimate the priority relation between the roads crossing the intersection. The operation limitation device may be configured to determine that a leftward orientation and a rightward orientation of the host vehicle are each an orientation in which it is estimated that the target vehicle will not collide with the host vehicle for regulatory reasons and to inhibit the operation of the alert device for the target vehicle that is approaching the host vehicle from that orientation, if it is estimated that the road crossing the intersection has not priority over the host vehicle traveling road.

It is estimated that a vehicle traveling on a non-priority road stops before an intersection before entering the intersection. In view of this, the intersection information acquisition device acquires the information that can be used to estimate the priority relation between the roads crossing the intersection. As a result, if it is estimated that the road crossing the intersection has not priority over the host vehicle traveling road, the operation limitation device determines that the leftward orientation and the rightward orientation of the host vehicle are each an orientation in which it is estimated that the target vehicle will not collide with the host vehicle for regulatory reasons and inhibits the operation of the alert device for the target vehicle that is approaching the host vehicle from that orientation. Therefore, the alerts to the driver can be limited properly.

The intersection information acquisition device may be configured to acquire, as the intersection information, information that can be used to estimate whether a stop sign for the host vehicle traveling road is installed at a position where the host vehicle traveling road is connected to the intersection. The operation limitation device may be configured to determine that the leftward orientation and the rightward orientation of the host vehicle are each an orientation in which it is estimated that the target vehicle will not collide with the host vehicle for regulatory reasons and to inhibit the operation of the alert device for the target vehicle that is approaching the host vehicle from that orientation, if it is estimated that the stop sign is not installed at the position.

The priority relation between the roads connected to an intersection can be estimated by the presence or absence of the stop sign for the host vehicle traveling road. In view of this, the intersection information acquisition device acquires information that can be used to estimate whether the stop sign for the host vehicle traveling road is installed at the position where the host vehicle traveling road is connected to the intersection. As a result, if it is estimated that the stop sign is not installed at the position, the operation limitation device determines that the leftward orientation and the rightward orientation of the host vehicle are each an orientation in which it is estimated that the target vehicle will not collide with the host vehicle for regulatory reasons and inhibits the operation of the alert device for the target vehicle that is approaching the host vehicle from that orientation. Therefore, the alerts to the driver can be limited properly.

The vehicle alert apparatus may further includes a blinker detection unit configured to detect an activation state of a blinker of the host vehicle and a forward orientation alert operation limitation device configured to inhibit the operation of the alert device for the target vehicle that is approaching from a forward direction to the host vehicle unless the blinker detection unit detects that the blinker indicates a direction crossing an oncoming lane.

When turning an intersection in such a way that a vehicle crosses the oncoming lane (when a left-hand traffic vehicle turns right and when a right-hand traffic vehicle turns left), there is a need to make the driver pay attention to an oncoming vehicle in the forward direction. In view of this, the blinker detection unit detects the activation state of the blinker of the host vehicle. As a result, unless the blinker detection unit detects that the blinker indicates the direction crossing the oncoming lane, the forward orientation alert operation limitation device inhibits the operation of the alert device for the target vehicle that is approaching from the forward direction to the host vehicle. Therefore, the alerts to the driver can be limited properly while maintaining the function to alert the driver to the approach of the oncoming vehicle.

The present disclosure can also achieve the purpose described above by allowing the above-described operation limitation device to have the configuration for narrowing down assistance-target orientations in which an alert is to be given.

In this case, the operation limitation device may be configured to include a narrowing device configured to narrow down assistance-target orientations by excluding at least one of the orientation of the other vehicle, in which it is estimated that the other vehicle cannot collide with the host vehicle based on the intersection information, or the orientation of the other vehicle, in which it is estimated that the other vehicle will not collide with the host vehicle for regulatory reasons based on the intersection information, from assistance-target orientations in which an alert is to be given, and the operation limitation device may be configured to inhibit the operation of the alert device for the target vehicle when the target vehicle detected by the target vehicle detection device is not present in the assistance-target orientations narrowed down by the narrowing device.

The operation limitation device includes the narrowing device. The narrowing device narrows down the assistance-target orientations by excluding at least one of the orientation of the other vehicle, in which it is estimated that the other vehicle cannot collide with the host vehicle based on the intersection information, or the orientation of the other vehicle, in which it is estimated that the other vehicle will not collide with the host vehicle for regulatory reasons based on the intersection information, from assistance-target orientations in which an alert is to be given. The operation limitation device inhibits the operation of the alert device for the target vehicle when the target vehicle detected by the target vehicle detection device is not present in the assistance-target orientations narrowed down by the narrowing device.

Therefore, if the other vehicle is approaching the host vehicle but if the other vehicle is estimated not to actually collide with the host vehicle, an alert is not given to the driver. This reduces the frequency with which unnecessary alerts are given. As a result, this prevents the driver from feeling annoyed.

The intersection information acquisition device may be configured to acquire, as the intersection information, intersection information that represents a situation of the intersection including a grade separated location, where a host vehicle traveling road and another road are grade separated and that can be used to estimate whether the intersection is the grade separated location. The narrowing device may be configured to exclude a leftward orientation and a rightward orientation, in which the other vehicle cannot collide with the host vehicle, from the assistance-target orientations if it is estimated that the intersection is the grade separated location.

According to the configuration described above, the alerts to the driver can be limited properly.

The intersection information acquisition device may be configured to acquire, as the intersection information, information that can be used to estimate a presence or absence of a median strip in the intersection, and the narrowing device may be configured to set an orientation of the other vehicle in which it is estimated that the other vehicle cannot collide with the host vehicle based on a median strip direction with respect to the host vehicle and to exclude the set orientation from the assistance-target orientations, if it is estimated that the median strip is provided in the intersection.

According to the configuration described above, the alerts to the driver can be limited properly.

The intersection information acquisition device may be configured to acquire, as the intersection information, information that can be used to estimate whether a traffic light is installed at the intersection, and the narrowing device may be configured to exclude a leftward orientation and a rightward orientation, in which it is estimated that the other vehicle will not collide with the host vehicle for regulatory reasons, from the assistance-target orientations if it is estimated that the traffic light is installed at the intersection.

According to the configuration described above, the alerts to the driver can be limited properly.

The intersection information acquisition device may be configured to acquire, as the intersection information, information that can be used to estimate a priority relation between roads crossing the intersection, and the narrowing device may be configured to exclude the leftward orientation and the rightward orientation, in which it is estimated that the other vehicle will not collide with the host vehicle for regulatory reasons, from the assistance-target orientations if the host vehicle traveling road has priority over the other road crossing the intersection.

According to the configuration described above, the alerts to the driver can be limited properly.

The intersection information acquisition device may be configured to acquire, as the intersection information, information that can be used to estimate whether a stop sign is installed at a position where the host vehicle traveling road is connected to the intersection. The narrowing device may be configured to exclude the leftward orientation and the rightward orientation, in which it is estimated that the other vehicle will not collide with the host vehicle for regulatory reasons, from the assistance-target orientations if it is estimated that the stop sign is not installed at the position.

According to the configuration described above, the alerts to the driver can be limited properly.

The vehicle alert apparatus may further include a blinker detection unit configured to detect an activation state of a blinker of the host vehicle, a forward orientation exclusion device configured to exclude a forward orientation of the host vehicle from the assistance-target orientations unless the blinker detection unit detects that the blinker indicates a direction crossing an oncoming lane, and a forward orientation alert operation limitation device configured to inhibit the operation of the alert device for the target vehicle when the target vehicle detected by the target vehicle detection device is present in the forward orientation that has been excluded by the forward orientation exclusion device.

According to the configuration described above, the alerts to the driver can be limited properly while maintaining the function to alert the driver to the approach of an oncoming vehicle.

A second aspect of the present disclosure relates to a vehicle alert apparatus including target vehicle detection means for carrying out vehicle-vehicle communication with another vehicle around a host vehicle to determine an approaching state between the host vehicle and the other vehicle when the host vehicle is going to enter an intersection and, based on the approaching state, detects another vehicle that may collide with the host vehicle as an alert target vehicle, alert means for operating an alert unit to make a driver pay attention to the target vehicle when the target vehicle is detected, intersection information acquisition means for acquiring intersection information that represents a situation of an intersection where the host vehicle is going to enter, and operation limitation means for inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information.

A third aspect of the present disclosure relates to A vehicle alert apparatus including a communication device that carries out vehicle-vehicle communication with the other vehicle around a host vehicle, an alert unit that make a driver pay attention to another vehicle that may collide with the host vehicle as an alert target vehicle, an electronic control unit programmed to determine an approaching state between the host vehicle and the other vehicle based on a signal received by the communication device via the vehicle-vehicle communication when the host vehicle is going to enter an intersection and, based on the approaching state, detects another vehicle that may collide with the host vehicle as the alert target vehicle, operates the alert unit to make the driver pay attention to the alert target vehicle when the alert target vehicle is detected, acquires intersection information that represents a situation of the intersection where the host vehicle is going to enter; and inhibits an operation of the alert unit for the alert target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
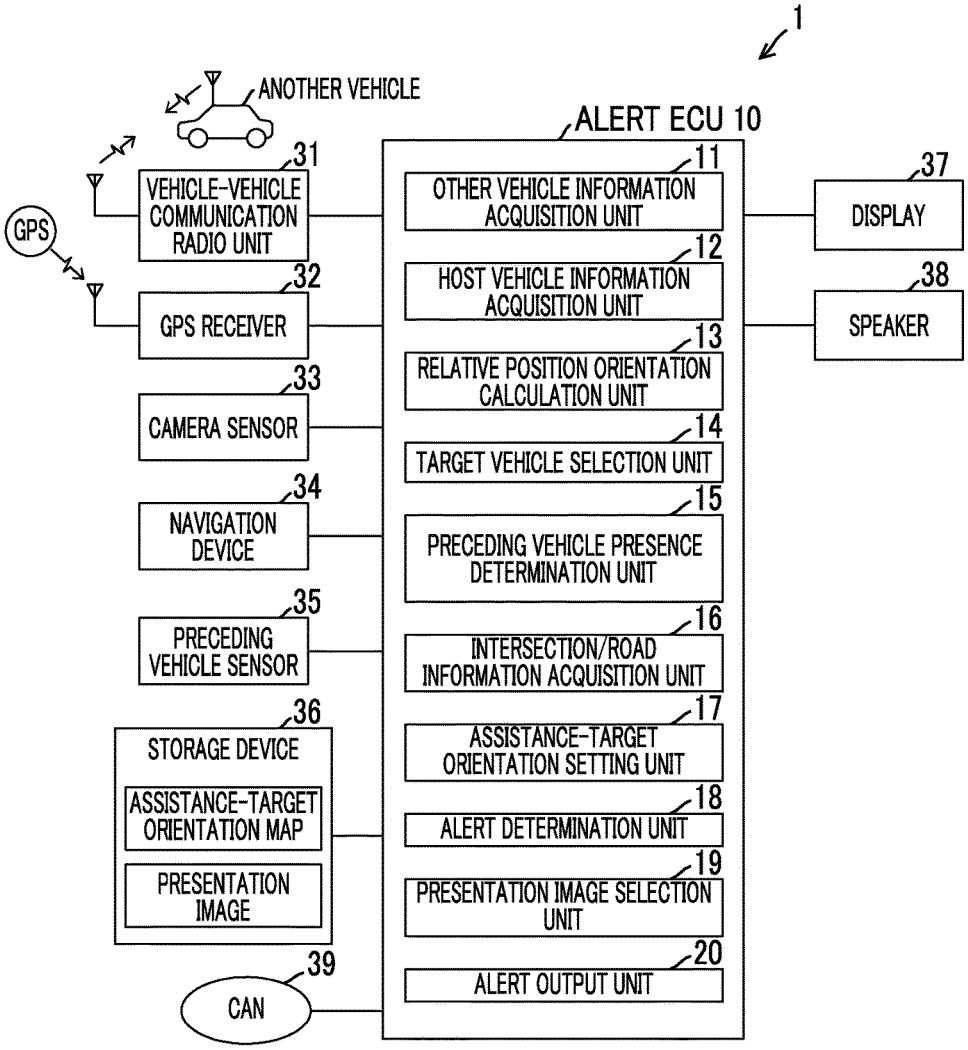
FIG. 1 is a general system configuration diagram showing a vehicle alert apparatus in this embodiment.

An embodiment of the present disclosure is described in detail below with reference to the drawings. FIG. 1 is a general system configuration diagram showing a vehicle alert apparatus in this embodiment. In this specification, it is assumed that the vehicle alert apparatus in this embodiment is used in a country where the road traffic regulations state that vehicles must travel on the left side.

A vehicle alert apparatus 1 includes an alert ECU 10 having a microcomputer as its main component. ECU is an abbreviation for Electronic Control Unit. In this specification, it is assumed that the microcomputer, which includes a CPU and storage devices such as a ROM and a RAM, executes instructions (program) stored in the ROM to implement various functions. A vehicle on which this vehicle alert apparatus is mounted is called a "host vehicle" when it is necessary to distinguish the vehicle from other vehicles.

The alert ECU 10 is connected to a vehicle-vehicle communication radio unit 31, a GPS receiver 32, a camera sensor 33, a navigation device 34, a preceding vehicle sensor 35, a storage device 36, a display 37, a speaker 38, and a vehicle information network (CAN: Control Area Network) 39.

The vehicle-vehicle communication radio unit 31, which is a unit for communicating with another vehicle traveling around the host vehicle and having the vehicle-vehicle communication function, includes a communication antenna and a communication processing device. The vehicle-vehicle communication radio unit 31 sends the vehicle-vehicle communication signal to the other vehicles that are present within the vehicle-vehicle communication range in which communication can be carried out from the host vehicle using the communication antenna and, at the same time, receives the vehicle-vehicle communication signal from the other vehicles that are present within the vehicle-vehicle communication range. When the vehicle-vehicle communication signal is received from another vehicle, the vehicle-vehicle communication radio unit 31 demodulates the vehicle-vehicle communication signal, extracts the information from the other vehicle, and supplies the extracted information to the alert ECU 10. In addition, the vehicle-vehicle communication radio unit 31 modulates the host vehicle information, supplied from the alert ECU 10, and sends the modulated signal via the communication antenna. The information sent and received by the vehicle-vehicle communication includes the absolute position, absolute orientation angle, and vehicle speed of the host vehicle (or of the other vehicle when the information is received).

The GPS receiver 32, which is a device for receiving the GPS signal sent from the GPS satellites to detect the absolute position of the host vehicle, includes a GPS antenna and a communication processing device. The GPS receiver 32 receives the GPS signal from the GPS satellites using the GPS antenna, demodulates the GPS signal at regular time intervals, calculates the absolute position (latitude and longitude) of the host vehicle based on the information on the demodulated GPS signal, and sends the information indicating the absolute position to the alert ECU 10.

The camera sensor 33 includes an in-vehicle camera for capturing the area in front of the host vehicle and an image processing device for processing the images captured by the in-vehicle camera. The camera sensor 33 analyzes the image information, output from the in-vehicle camera, using the image processing device to recognize the road signs and traffic lights included in the captured image and, then, sends the information on the recognized road signs (road sign information) and the information on the recognized traffic lights (traffic light information) to the alert ECU 10.

The navigation device 34 includes a database that stores map information, a touch panel that is a human-machine interface for performing route guidance and so on, and a data processing device that performs various types of arithmetic processing based on the information stored in the database. In addition, the navigation device 34 has the function to extract necessary information from the database and supply the extracted information to the alert ECU 10. The map information stored in the database includes the road information (including intersection information). The road information includes the node information on the nodes, which represent the intersections and other nodes used to represent a road network, and the link information on the links each of which represents the road section between each two nodes.

The preceding vehicle sensor 35 is a sensor for detecting a preceding vehicle traveling ahead of the host vehicle. For example, a radar sensor is used for the preceding vehicle sensor 35. The preceding vehicle sensor 35 emits millimeter-band radio waves (called millimeter waves) in the traveling direction of the host vehicle. If, within the emission range, there is a preceding vehicle that reflects the millimeter waves, the preceding vehicle sensor 35 uses the reflected waves to detect the distance between the host vehicle and the preceding vehicle, the direction of the preceding vehicle with respect to the host vehicle, and the relative speed of the preceding vehicle relative to the host vehicle. The preceding vehicle sensor 35 supplies the information on the preceding vehicle to the alert ECU 10. The preceding vehicle sensor 35 is not limited to the radar sensor. For example, instead of the radar sensor, the camera sensor 33 equipped with a stereo camera may be used for the preceding vehicle sensor 35.

The storage device 36, for example, a device such as a semiconductor memory or a hard disk, stores the assistance-target orientation map and the alert presentation images that will be described later.

The display 37 is, for example, a head-up display (hereinafter referred to as an HUD). The HUD receives display information from various ECUs, included in the host vehicle, and the navigation device 34 and displays the received display information in a partial area (display area) of the windshield of the host vehicle. When an alert target, which will be described later, is detected, the alert ECU 10 sends an alert presentation image to the HUD. Upon receiving the alert presentation image, the HUD displays the alert presentation image in a part of the display area. The display 37 is not limited to the HUD. Instead of the HUD, a meter display or the touch panel of the navigation device 34 may be used for the display 37. The meter display is a display panel in which meters such as the speedometer, tachometer, fuel gauge, coolant temperature gauge, ODO/Trip meter, and warning lamps are assembled and arranged on the dashboard.

The speaker 38 sounds in response to the alert sound signal, supplied from the alert ECU 10, to alert the driver. Instead of the speaker 38, a buzzer may be used.

The vehicle information network 39, which is an in-vehicle network connected to various vehicle control ECUs and various sensors, supplies the sensor information to the alert ECU 10. The sensor information that the alert ECU 10 receives from the vehicle information network 39 includes the information on the host vehicle such as the vehicle speed information, orientation information, and blinker information. The orientation information, which is the information obtained by the orientation angle sensor, represents the absolute orientation angle in which the vehicle body is facing (for example, with the north being 0 degrees (360 degrees), the absolute orientation angle increases clockwise such that the east is 90 degrees, the south is 180 degrees, and the west is 270 degrees). The blinker information, which is generated by the blinker switch, represents the activation state of the blinker.

The alert ECU 10 is configured by a microcomputer. The alert ECU 10 includes the following functional units: other vehicle information acquisition unit 11, host vehicle information acquisition unit 12, relative position orientation calculation unit 13, target vehicle selection unit 14, preceding vehicle presence/absence determination unit 15, intersection/road information acquisition unit 16, assistance-target orientation setting unit 17, alert determination unit 18, presentation image selection unit 19, and alert output unit 20.

The other vehicle information acquisition unit 11 acquires the other vehicle information via the vehicle-vehicle communication radio unit 31. The other vehicle information includes the absolute position, absolute orientation, and vehicle speed of another vehicle around the host vehicle. In this case, the other vehicle includes a vehicle-vehicle communication radio unit, a GPS receiver, an orientation angle sensor, and a vehicle speed sensor. The other vehicle sends the information (other vehicle information), which represents the absolute position of the other vehicle detected by the GPS receiver, absolute orientation angle detected by the orientation angle sensor, and vehicle speed detected by the vehicle speed sensor, to the host vehicle via the vehicle-vehicle communication radio unit.

The host vehicle information acquisition unit 12 acquires the host vehicle information. The host vehicle information includes the absolute position of the host vehicle detected by the GPS receiver 32 and the information obtained via the vehicle information network 39 (absolute orientation angle that is the value detected by the orientation angle sensor, vehicle speed that is the value detected by the vehicle speed sensor). In addition, the host vehicle information acquisition unit 12 sends the host vehicle information to the other vehicles around the host vehicle via the vehicle-vehicle communication radio unit 31. The host vehicle information acquisition unit 12 also acquires the blinker information (detected signal indicating the state of the blinker switch) representing the activation state of the blinker of the host vehicle.

The relative position orientation calculation unit 13 calculates the relative position and the relative orientation between the host vehicle and another vehicle, based on the other vehicle information acquired by the other vehicle information acquisition unit 11 and the host vehicle information acquired by the host vehicle information acquisition unit 12. The relative position represents the position of the other vehicle with respect to the position of the host vehicle. The relative orientation represents the direction of the other vehicle with respect to the host vehicle, and the orientation in which the other vehicle is facing relative to the orientation in which the host vehicle is facing.

The target vehicle selection unit 14 checks the approaching state between the host vehicle and another vehicle, based on the relative position and the relative orientation calculated by the relative position orientation calculation unit 13, the vehicle speed of the host vehicle, and the vehicle speed of another vehicle, and selects another vehicle that may collide with the host vehicle. For example, when another vehicle is expected to enter a predetermined area that is a set distance ahead of the host vehicle, the target vehicle selection unit 14 calculates the prediction time that will elapse from the current time to the time the other vehicle will enter the predetermined area (called "collision prediction time"), and selects the other vehicle, whose collision prediction time is equal to or less than the alert threshold, as an alert target vehicle (another vehicle which may collide with the host vehicle). The collision prediction time can be calculated, for example, by dividing the distance between the other vehicle and the predetermined area by the vehicle speed of the other vehicle. The selected target vehicle is a candidate for the alert target and is determined to be the final alert target vehicle only when the selected target vehicle is in the assistance-target orientation that is set by the assistance-target orientation setting unit 17 that will be described later.

The preceding vehicle presence determination unit 15 receives the information, output from the preceding vehicle sensor 35, to determine whether there is a preceding vehicle (a vehicle traveling ahead of the host vehicle in the same direction as the host vehicle). In this case, the preceding vehicle presence determination unit 15 determines that there is a preceding vehicle ahead of the host vehicle if the distance (inter-vehicle distance) between the host vehicle and the preceding vehicle is equal to or less than a predetermined distance that is set in advance and if the vehicle speed of the preceding vehicle is equal to or lower than the speed that is set in advance.

The intersection/road information acquisition unit 16 acquires the information on an intersection where the host vehicle is going to enter and the information on the roads connected to the intersection. For example, the intersection/road information acquisition unit 16 searches the database of the navigation device 34, based on the host vehicle position (latitude, longitude) detected by the GPS receiver 32, to acquire the node information and the link information on the region around the host vehicle. The node information includes the information indicating the positions (latitude, longitude) of intersections. Therefore, from the host vehicle position information and the node information, it is possible to get the information about the position of the intersection ahead of the road on which the host vehicle is traveling. The node information also includes the information indicating a location (position) where the road is grade separated. Therefore, the information indicating the position of the intersection also includes the information indicating a location (position) where the road is grade separated.

The node information also includes the traffic light presence/absence information indicating whether there is a traffic light at each node. This makes it possible to determine whether there is a traffic light at the intersection where the host vehicle is going to enter. When the camera sensor 33 has the ability to recognize a traffic light based on the image of the area ahead of the host vehicle, this ability may also be used to determine whether there is a traffic light.

The link information includes the median strip presence/absence information indicating whether or not a median strip is provided for each link. This makes it possible to determine whether there is a median strip on the roads around the host vehicle.

Figure 4:
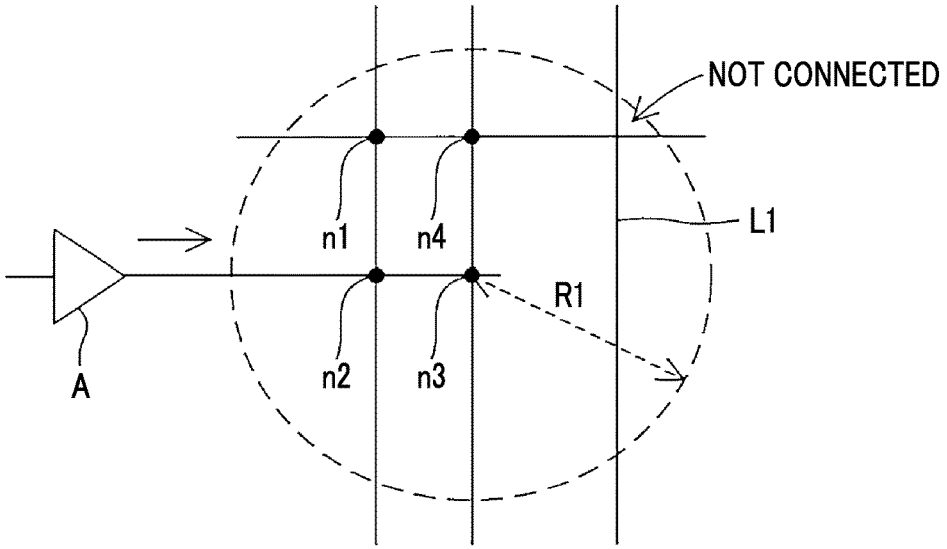
FIG. 4 is a diagram showing a method for determining a grade separated intersection.

In addition, based on the node information and the link information, it is possible to estimate whether the intersection, where the host vehicle is going to enter, is grade separated. For example, the links each passing through the area within a predetermined radius from the intersection where the host vehicle is going to enter (referred to as the target intersection) are extracted to determine whether there is a link that is not connected to the target intersection. If there is such a link, it can be estimated that the target intersection is grade separated. For example, FIG. 4 shows an example in which the four nodes, n1, n2, n3, and n4, form one target intersection and, within a radius of R1 meters from the node n3 (arbitrary point of the target intersection), there is the link L1 that is not connected to the target intersection (in FIG. 4, the host vehicle A is shown). In this circumstance, there is a possibility that the target intersection is grade separated and, in this embodiment, it is estimated that such an intersection is grade separated. In addition, the information indicating the presence or absence of a grade separated intersection, when included in the node information, may be used to estimate whether there is a grade separated intersection.

As described above, the method for estimating whether the target intersection is grade separated does not guarantee high estimation accuracy. However, the vehicle alert apparatus in this embodiment is designed to prevent the driver from feeling annoyed with unnecessary (excessive) alerts as much as possible. In addition, as will be described later, an alert to the driver is inhibited if it is estimated that the target intersection is grade separated. For this reason, though the estimation accuracy is low in the method described above, the vehicle alert apparatus in this embodiment estimates that the intersection is grade separated if a factor implying that the target intersection is grade separated is detected (that is, near the target intersection, there is a link not connected to the target intersection).

The intersection/road information acquisition unit 16 acquires the road sign information sent from the camera sensor 33. The road sign information is the information that identifies the type of road signs. In this embodiment, it is determined whether there is a stop sign in front of the host vehicle based on this road sign information.

This intersection/road information acquisition unit 16 is regarded as the intersection information acquisition unit of the present disclosure.

The assistance-target orientation setting unit 17 executes the assistance-target orientation setting routine, which will be described later, based on the various types of information acquired from the intersection/road information acquisition unit 16 and the blinker operation detecting unit, to narrow down the orientations in which alert assistance is to be provided (called the assistance-target orientation). The orientation that is set by the assistance-target orientation setting unit 17 indicates the position of another vehicle with respect to the host vehicle, that is, the relative direction of the other vehicle with respect to the host vehicle.

The assistance-target orientation map, stored in the storage device 36, is data generated by classifying the assistance-target orientations. This assistance-target orientation map defines the following three ranges of orientation: forward orientation that is a predetermined angular range in front of the host vehicle A (a range spreading at a predetermined angle to the left and right with respect to the front side axis in the vehicle longitudinal direction) as shown in FIG.

Figure 5A:
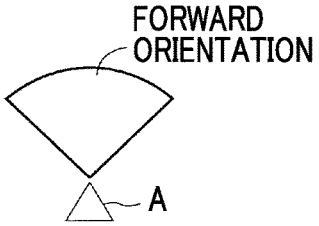
FIG. 5A is a diagram showing an assistance-target orientation (forward orientation)
Figure 5B:
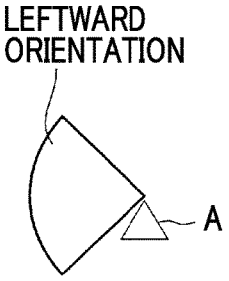
FIG. 5B is a diagram showing an assistance-target orientation (leftward orientation)
Figure 5C:
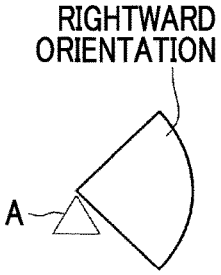
FIG. 5C is a diagram showing an assistance-target orientation (rightward orientation)

5A, leftward orientation that is a predetermined angular range on the left side of the host vehicle (a range spreading at a predetermined angle to the front and back with respect to the left side axis in the vehicle width direction) as shown in FIG. 5B, and rightward orientation that is a predetermined angular range on the right side of the host vehicle (a range spreading at a predetermined angle to the front and back with respect to the right side axis in the vehicle width direction) as shown in FIG. 5C. The assistance-target orientation setting unit 17 selects an arbitrary orientation from the three orientations, classified according to the assistance-target orientation map, to set the selected orientation as the assistance-target orientation. The backward orientation of the host vehicle is not originally included in the assistance-target orientation.

The alert determination unit 18 determines whether an alert is to be given to the driver, based on the orientation in which the target vehicle selected by the target vehicle selection unit 14 is present and on the assistance-target orientation that is set by the assistance-target orientation setting unit 17. More specifically, if the target vehicle selected by the target vehicle selection unit 14 is present in the assistance-target orientation that is set by the assistance-target orientation setting unit 17, the alert determination unit 18 determines that an alert to the driver for the target vehicle is necessary. Conversely, if the target vehicle is selected by the target vehicle selection unit 14 but if the target vehicle is not present in the assistance-target orientation that is set by the assistance-target orientation setting unit 17, the alert determination unit 18 determines that the alert to the driver is not necessary.

Therefore, whether to permit or inhibit an alert to the driver is determined according to the assistance-target orientation that is set by the assistance-target orientation setting unit 17.

The presentation image selection unit 19 selects an alert presentation image (hereinafter, simply referred to as a presentation image), which corresponds to the assistance-target orientation in which the target vehicle is located, when the alert determination unit 18 determines that an alert to the driver for the target vehicle is necessary. The storage device 36 stores four types of presentation images, F1, F2, F3, and F4, as shown in FIGS. 6A to 6D.

Figure 6A:
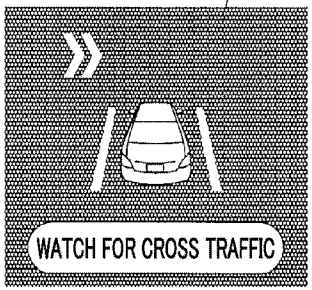
FIG. 6A is a diagram showing a presentation image.

The presentation image F1 shown in FIG. 6A is selected when the leftward orientation is included in the assistance-target orientation and, in addition, the target vehicle is detected in the leftward orientation. When the host vehicle is going to enter the intersection, this presentation image F1 is presented to make the driver pay attention to another vehicle that will enter the intersection from the leftward orientation of the host vehicle.

Figure 6B:
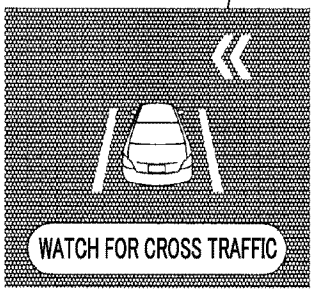
FIG. 6B is a diagram showing a presentation image.

The presentation image F2 shown in FIG. 6B is selected when the rightward orientation is included in the assistance-target orientation and, in addition, the target vehicle is detected in the rightward orientation. When the host vehicle is going to enter the intersection, this presentation image F2 is presented to make the driver pay attention to another vehicle that will enter the intersection from the rightward orientation of the host vehicle.

Figure 6C:
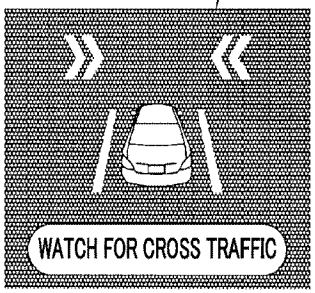
FIG. 6C is a diagram showing a presentation image.

The presentation image F3 shown in FIG. 6C is selected when the leftward orientation and the rightward orientation are included in the assistance-target orientation and, in addition, the target vehicle is detected in the leftward orientation and in the rightward orientation. When the host vehicle is going to enter the intersection, this presentation image F3 is presented to make the driver pay attention to the other vehicles that will enter the intersection from the rightward orientation and the leftward orientation of the host vehicle.

Each of the presentation images F1, F2, and F3 is selected if there is a possibility that the host vehicle will head-on collide with another vehicle when the host vehicle enters the intersection. Therefore, these presentation images F1, F2, and F3 are hereinafter referred to as "head-on collision alert images".

Figure 6D:
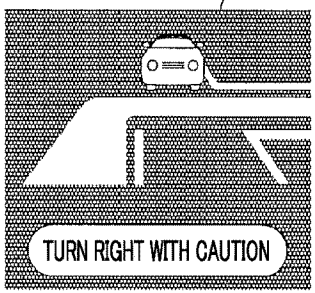
FIG. 6D is a diagram showing a presentation image.

The presentation image F4 shown in FIG. 6D is selected when the forward orientation is included in the assistance-target orientation and, in addition, the target vehicle is detected in the forward orientation. When the host vehicle is going to turn right at the intersection, this presentation image F4 is presented to make the driver pay attention to the oncoming vehicle that travels straight ahead from the forward orientation to the intersection. This presentation image is hereinafter referred to as a "right-turn collision alert image".

The presentation images F1 to F4 may be designed arbitrarily. The presentation image may be simply an icon without displaying text such as "Watch for Cross Traffic" or "Turn Right with Caution". In addition, instead of indicating the orientation of the target vehicle by an arrow, the presentation image may also be a text display image, such as "Look Left", "Look Right", "Look Both ways", or "Look Straight Ahead", that makes the driver pay attention to the indicated direction.

The alert output unit 20 sends the information indicating the presentation image, selected by the presentation image selection unit 19, to the display 37, and sends the alert sound signal to the speaker 38, when the alert determination unit 18 determines that an alert to the driver for the target vehicle is necessary. This processing of the alert output unit 20 causes the display 37 to display the presentation image and causes the speaker 38 to generate the alert sound.

Figure 2:
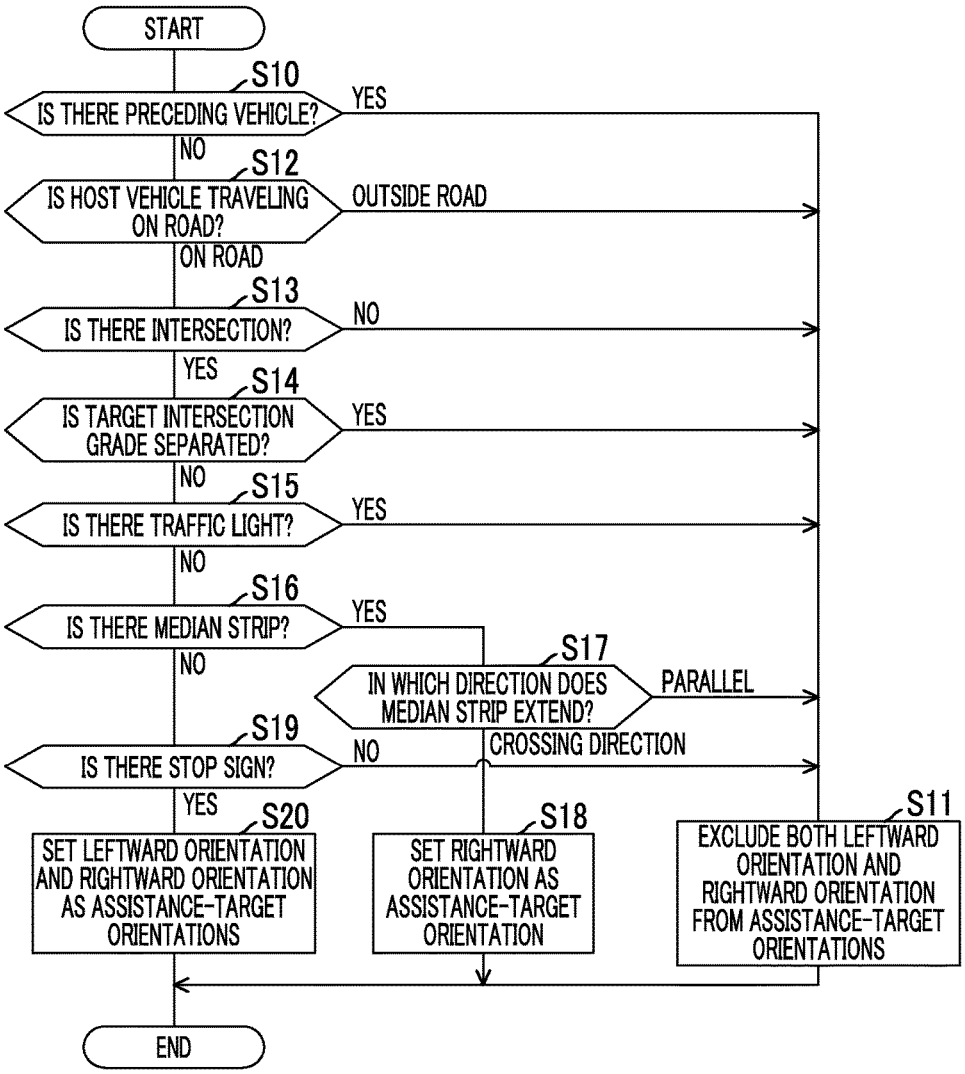
FIG. 2 is a flowchart showing the head-on collision prevention assistance-target orientation setting routine.
Figure 3:
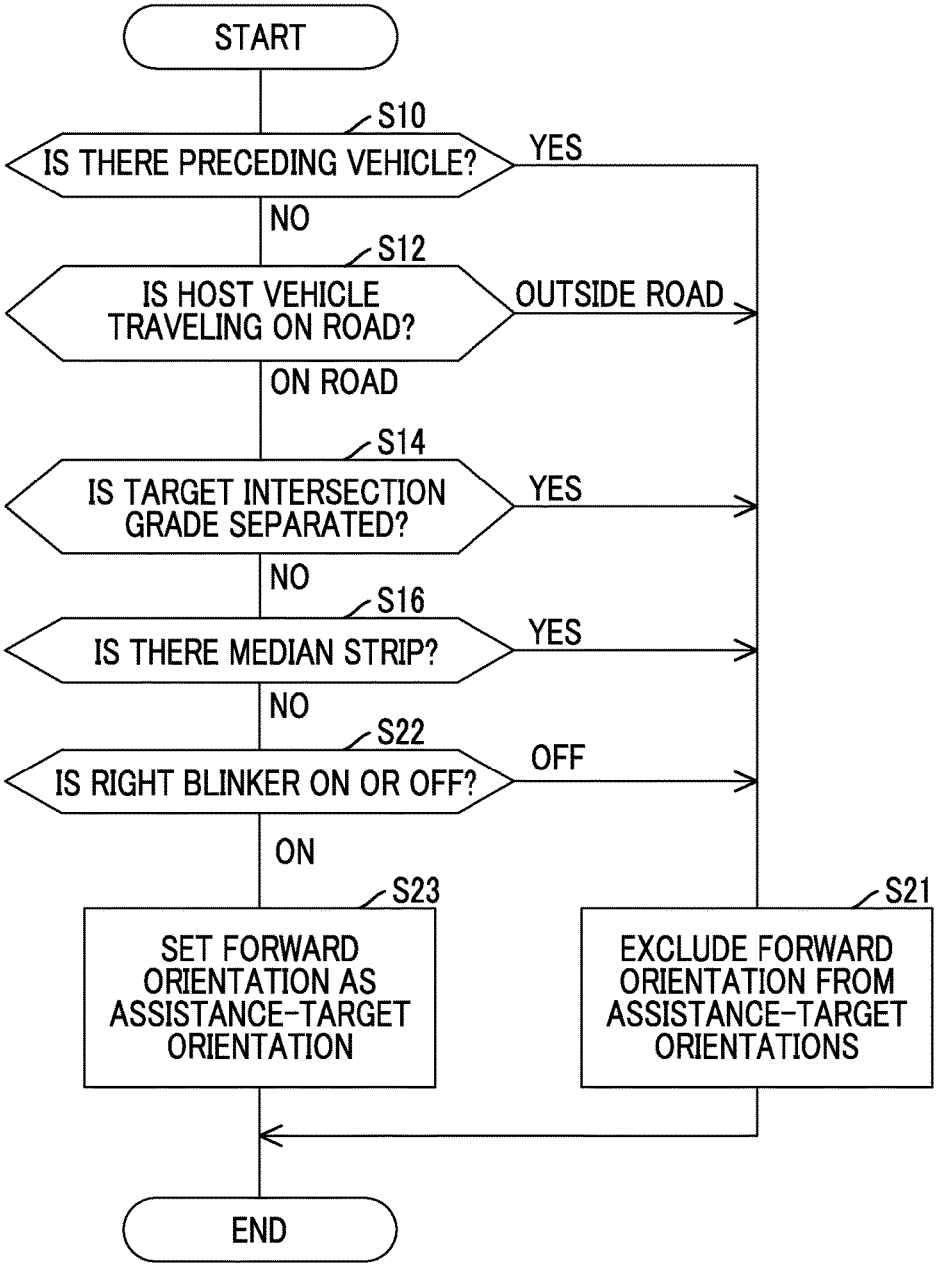
FIG. 3 is a flowchart showing the right-turn collision prevention assistance-target orientation setting routine.

Next, the assistance-target orientation setting routine executed by the assistance-target orientation setting unit 17 is described. FIG. 2 shows the assistance-target orientation setting routine (referred to as "the head-on collision prevention assistance-target orientation setting routine") for setting an assistance-target orientation for preventing a head-on collision. FIG. 3 shows the assistance-target orientation setting routine (referred to as "the right-turn collision prevention assistance-target orientation setting routine") for setting an assistance-target orientation for preventing a collision with an on-coming vehicle when turning right (referred to as the right-turn collision).

The assistance-target orientation setting unit 17 concurrently executes the head-on collision prevention assistance-target orientation setting routine and the right-turn collision prevention assistance-target orientation setting routine at predetermined periodic calculation intervals. The head-on collision prevention assistance-target orientation setting routine sets an assistance-target orientation for the leftward orientation and rightward orientation of the host vehicle. On the other hand, the right-turn collision prevention assistance-target orientation setting routine sets an assistance-target orientation for the forward orientation of the host vehicle. The final assistance-target orientations, which are set by the assistance-target orientation setting unit 17, are the orientations that are the sum of the assistance-target orientations that are set by the head-on collision prevention assistance-target orientation setting routine and the assistance-target orientation that is set by the right-turn collision prevention assistance-target orientation setting routine.

First, the head-on collision prevention assistance-target orientation setting routine is described. When the head-on collision prevention assistance-target orientation setting routine is started, the assistance-target orientation setting unit 17 determines in step S10 whether there is a preceding vehicle. In this case, the assistance-target orientation setting unit 17 reads the determination result signal from the preceding vehicle presence determination unit 15. If the determination result indicates that there is a preceding vehicle, the assistance-target orientation setting unit 17 excludes the leftward orientation and the rightward orientation from the assistance-target orientations in step S11 and once terminates this routine. Since this routine is repeated at predetermined periodic calculation intervals, the assistance-target orientation setting unit 17 excludes the leftward orientation and/or the rightward orientation from the assistance-target orientations if the leftward orientation and/or the rightward orientation was set as the assistance-target orientations in the immediately preceding calculation.

If there is a preceding vehicle, the possibility that the host vehicle will head-on collide with another vehicle is very low. Therefore, in such a situation, the assistance-target orientation setting unit 17 does not set the assistance-target orientations for preventing a head-on collision.

If the determination result of the preceding vehicle presence determination unit 15 indicates that there is no preceding vehicle, the assistance-target orientation setting unit 17 determines in the subsequent step S12 whether the host vehicle is traveling on a road. In this case, the assistance-target orientation setting unit 17 determines whether the host vehicle is traveling on a road, based on the matching between the host vehicle position detected by the GPS receiver 32 and the road position stored in the database of the navigation device 34. If it is not determined that the host vehicle is located on a road, the assistance-target orientation setting unit 17 determines that the host vehicle is traveling outside a road. If it is determined that the host vehicle is traveling outside a road, the assistance-target orientation setting unit 17 executes the processing in step S11 and once terminates this routine. Therefore, the leftward orientation and the rightward orientation are not set as the assistance-target orientations.

Figure 7:
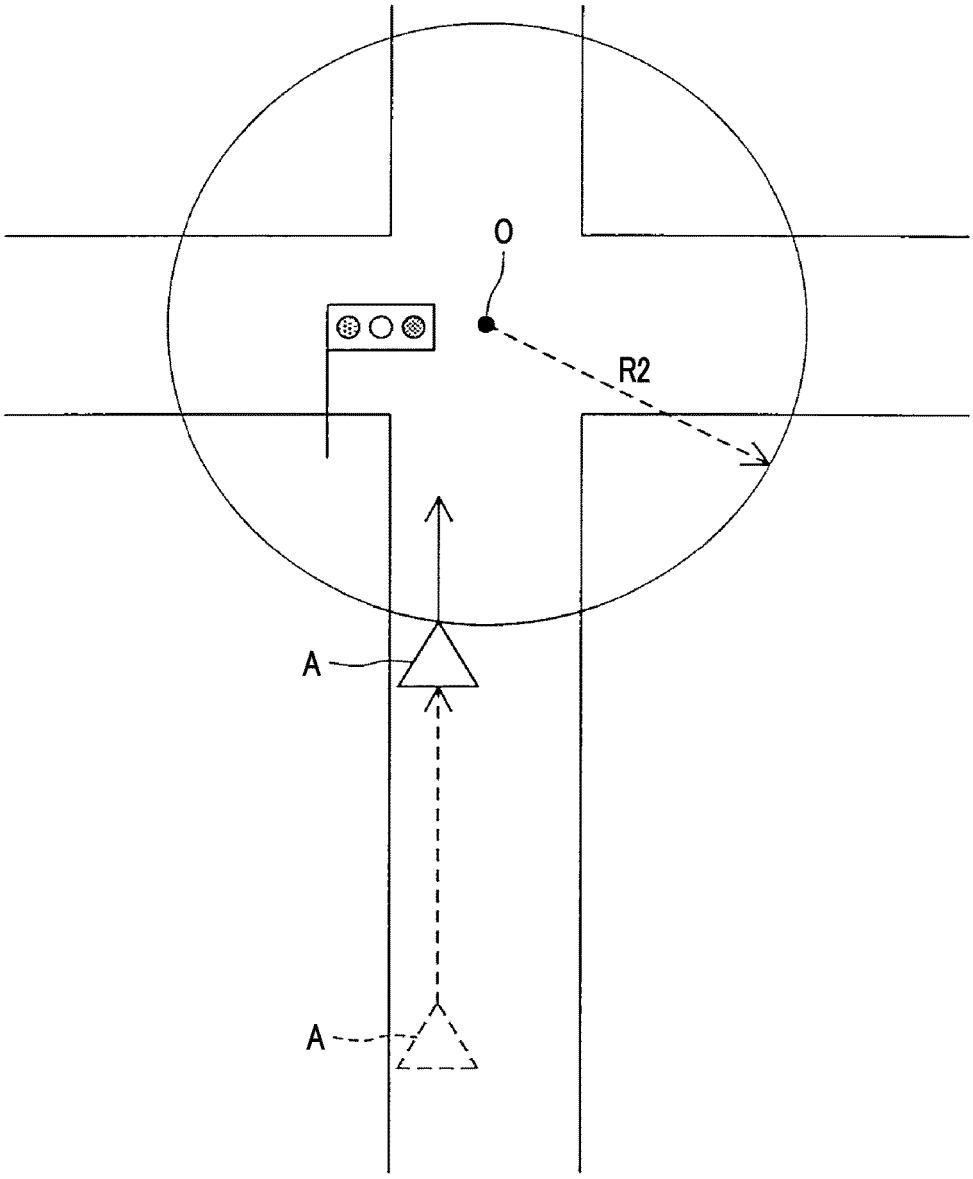
FIG. 7 is a diagram showing a method for determining whether there is an intersection.

If it is determined that the host vehicle is traveling on a road, the assistance-target orientation setting unit 17 determines in the subsequent step S13 whether there is an intersection. In this case, the assistance-target orientation setting unit 17 determines the position of the intersection around the host vehicle based on the position of the intersection identified by the node information acquired by the intersection/road information acquisition unit 16 and the host vehicle position detected by the GPS receiver 32. If the position of the host vehicle A is within a predetermined radius of R2 from the center position O of the intersection as shown in FIG. 7, the assistance-target orientation setting unit 17 determines that there is an intersection. In the description below, this intersection is referred to as the target intersection.

If the host vehicle is in a position away from the intersection (for example, if the position of the host vehicle A is outside a radius of R2), no head-on collision with another vehicle will occur. Therefore, in this case, the assistance-target orientation setting unit 17 executes the processing in step S11 and once terminates this routine. Therefore, the leftward orientation and the rightward orientation are not set as the assistance-target orientations.

If it is determined that there is an intersection (step S13: YES), the assistance-target orientation setting unit 17 determines in the subsequent step S14 whether the target intersection is grade separated. In this case, the assistance-target orientation setting unit 17 determines whether the target intersection is grade separated, based on the node information and the link information on the region around the host vehicle acquired by the intersection/road information acquisition unit 16. More specifically, the assistance-target orientation setting unit 17 extracts the links each passing through the area within a predetermined radius from the target intersection and, if there is a link that is not connected to the target intersection, determines that the target intersection is grade separated. When the node information includes the information indicating the presence or absence of a grade separated intersection, the assistance-target orientation setting unit 17 uses that information to determine whether the target intersection is grade separated.

When the host vehicle traveling road and another road are grade separated, the host vehicle cannot collide with another vehicle approaching from the left and right directions. In other words, a head-on collision cannot occur. Therefore, if it is determined that the target intersection is a grade separated intersection, the assistance-target orientation setting unit 17 determines that the other vehicle cannot collide with the host vehicle, executes the processing in step S11, and once terminates this routine.

If it is determined that the target intersection is not grade separated, the assistance-target orientation setting unit 17 determines in the subsequent step S15 whether a traffic light is installed at the target intersection. In this case, the assistance-target orientation setting unit 17 determines whether there is a traffic light, based on the traffic light presence/absence information included in the node information acquired by the intersection/road information acquisition unit 16. Instead, if a traffic light installed in front of the host vehicle is detected by the camera sensor 33, it may be determined that there is a traffic light.

At an intersection where a traffic light is installed, it is estimated that a head-on collision with another vehicle will not occur on the premise that the drivers comply with the regulations (road traffic regulations, etc.). The vehicle alert apparatus in this embodiment is designed with the purpose of preventing the driver from feeling annoyed with unnecessary (excessive) alerts. To achieve this purpose, the vehicle alert apparatus in this embodiment reduces the frequency of unnecessary alerts as much as possible at an intersection where a traffic light is installed, assuming that the drivers comply with the regulations. Therefore, when a traffic light is installed at the target intersection, the assistance-target orientation setting unit 17 determines that the leftward orientation and the rightward orientation of the host vehicle are each an orientation in which it is estimated that another vehicle will not collide with the host vehicle for regulatory reasons, executes the processing in step S11, and once terminates this routine.

If it is determined that a traffic light is not installed at the target intersection, the assistance-target orientation setting unit 17 determines in the subsequent step S16 whether a median strip is provided at the target intersection. In this case, the assistance-target orientation setting unit 17 determines whether a median strip is provided at the target intersection based on the median strip presence/absence information included in the link information acquired by the intersection/road information acquisition unit 16. For example, the assistance-target orientation setting unit 17 reads the median strip information on the roads (links) connected to the target intersection to determine whether the median strip is provided at the target intersection.

Figure 8A:
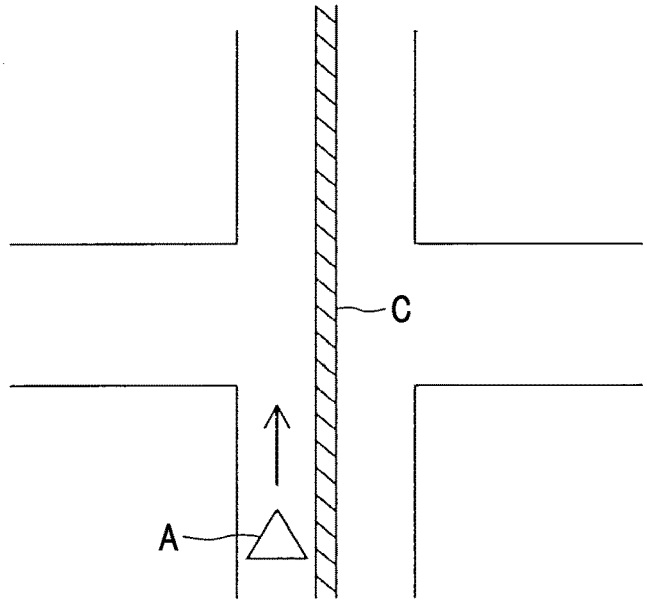
FIG. 8A is a diagram showing a median strip direction.

If it is determined that a median strip is provided at the target intersection, the assistance-target orientation setting unit 17 determines the median strip direction in the subsequent step S17. If the direction of the median strip C is parallel to the direction of the traveling road of the host vehicle A as shown in FIG. 8A, that is, if the median strip C provided on the traveling road of host vehicle A continues to the target intersection, a head-on collision with another vehicle cannot occur. Therefore, in this case, the assistance-target orientation setting unit 17 determines that the leftward orientation and the rightward orientation of the host vehicle are each an orientation in which it is estimated that collision with another vehicle cannot occur, executes the processing in step S11, and once terminates this routine.

Figure 8B:
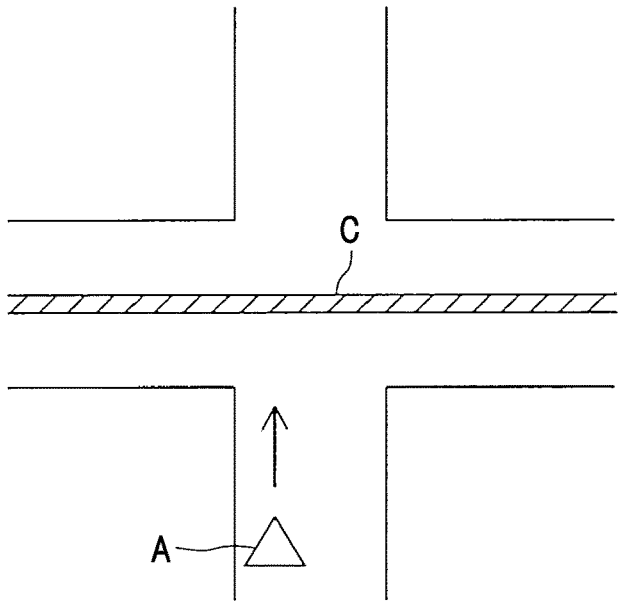
FIG. 8B is a diagram showing a median strip direction.

On the other hand, if the direction of the median strip C is the direction crossing the direction of the traveling road of the host vehicle A as shown in FIG. 8B, that is, if the median strip C is provided on the road other than the traveling road of the host vehicle A and if the median strip C continues to the intersection, there is a possibility that the host vehicle A will head-on collide with another vehicle entering the intersection from the rightward orientation of host vehicle A. In this case, the assistance-target orientation setting unit 17 sets the rightward orientation as the assistance-target orientation in step S18 and once terminates this routine. Therefore, out of the leftward orientation and the rightward orientation, only the rightward orientation is set as the assistance-target orientation. In addition, the leftward orientation, if set as the assistance-target orientation in the previous operation, is excluded from assistance-target orientations.

In some cases, the median strip is provided on the road but is not provided in the intersection to which the road is connected. Because such an intersection is a large intersection and, therefore, a traffic light is provided in that intersection in most cases, the intersection is already excluded in step S15 and is not processed in this step. In other words, it is determined in step S16 whether there is the median strip for a relatively small intersection where the traffic light is not installed. Therefore, as described above, the link information may be used to determine whether there is the median strip in the intersection.

Figure 9:
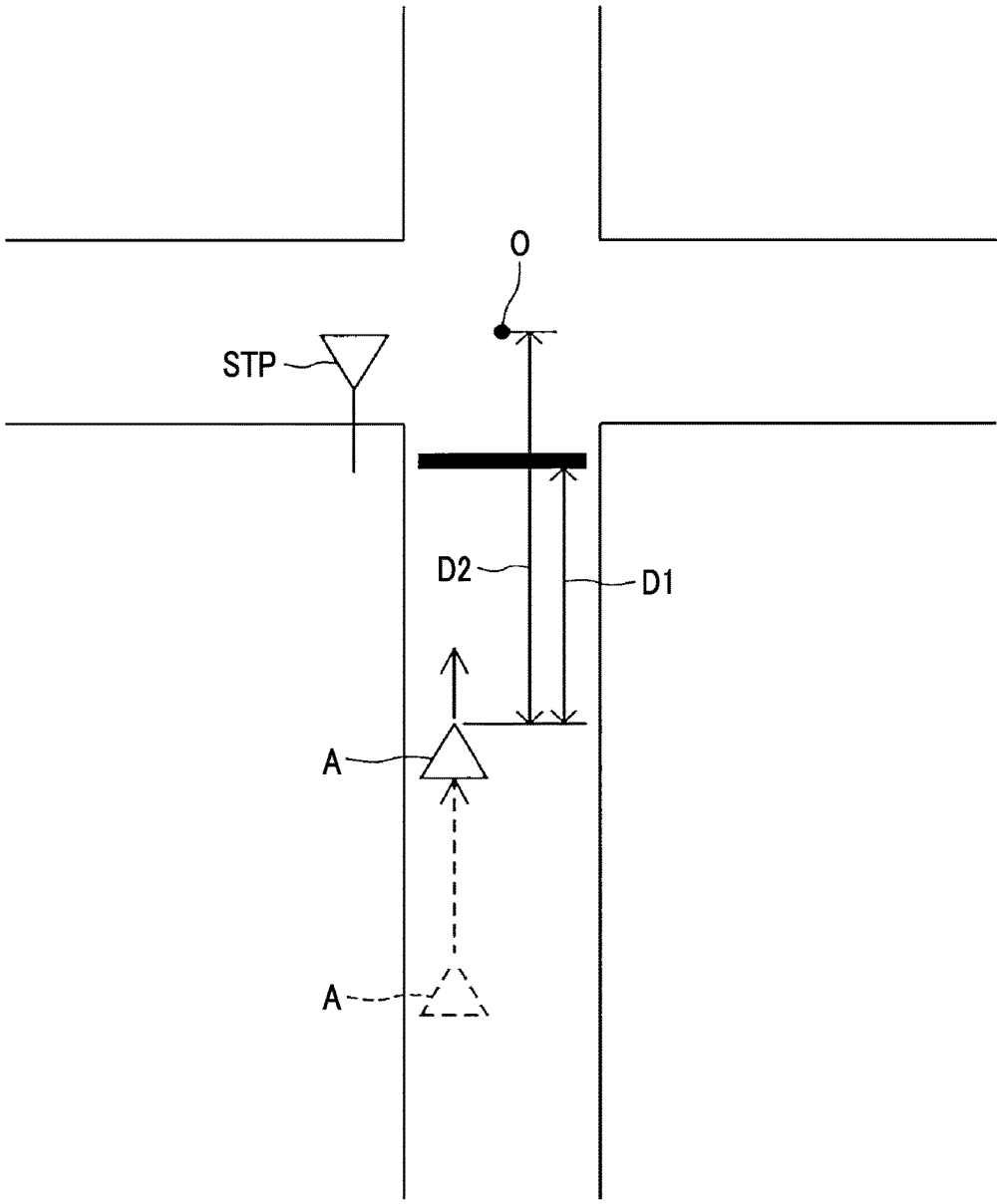
FIG. 9 is a diagram showing a method for determining whether there is a stop sign.

If it is determined that the median strip is not provided in the target intersection, the assistance-target orientation setting unit 17 determines in the subsequent step S19 whether the stop sign for the host vehicle traveling road is installed at the position where the host vehicle traveling road is connected to the target intersection. In this case, the assistance-target orientation setting unit 17 reads the road sign information acquired by the intersection/road information acquisition unit 16. If the stop sign is detected, the assistance-target orientation setting unit 17 calculates the remaining distance D1 from the host vehicle A (more precisely, from the camera sensor 33) to the stop sign STP and the remaining distance D2 from the host vehicle A to the center position O of the target intersection as shown in FIG. 9. The assistance-target orientation setting unit 17 calculates the difference $\Delta D(=|D1-D2|)$ between the remaining distances D1 and D2. If the difference $\Delta D$ is equal to or less than the threshold, the assistance-target orientation setting unit 17 determines that the stop sign STP for the host vehicle traveling road is installed (there is the stop sign) at the position where the traveling road of the host vehicle A is connected to the target intersection.

The assistance-target orientation setting unit 17 may also determine that "there is the stop sign" if the remaining distance D1 is equal to or smaller than threshold. It is also possible that the intersection/road information acquisition unit 16 determines whether there is the stop sign at the target intersection and, based on that determination, the assistance-target orientation setting unit 17 refers to the determination result in step S19.

If the stop sign is not provided at the position at which the host vehicle traveling road is connected to the target intersection, it can be estimated that the host vehicle traveling road has priority over the other road connected to the target intersection (That is, the host vehicle traveling road is a priority road). Therefore, it is considered that other vehicles traveling on the road crossing the host vehicle traveling road will temporarily stop before entering the target intersection. In other words, it is considered that a head-on collision with the host vehicle will not occur. As a result, if it is determined that the stop sign is not provided, the assistance-target orientation setting unit 17 determines that the leftward orientation and the rightward orientation of the host vehicle are each an orientation in which the other vehicle will not collide with the host vehicle for regulatory reasons, executes the processing in step S11, and once terminates this routine.

On the other hand, if the stop sign is provided at the position at which the host vehicle traveling road is connected to the target intersection, it can be estimated that the host vehicle traveling road has not priority over the other road connected to the target intersection (That is, the host vehicle traveling road is a non-priority road). Therefore, there is a high possibility that the other vehicle traveling on the road crossing the host vehicle traveling road will enter the target intersection without temporarily stopping before entering the target intersection. Therefore, there is a possibility that the host vehicle will head-on collide with the other vehicle.

For this reason, if it is determined that the stop sign is provided, the assistance-target orientation setting unit 17 sets the leftward orientation and the rightward orientation as the assistance-target orientations in step S20 and once terminates this routine. Therefore, only the leftward orientation and the rightward orientation are set as the assistance-target orientation.

The assistance-target orientation setting unit 17 repeats this routine at predetermined periodic calculation intervals. As a result, the assistance-target orientation for preventing a head-on collision is set according to the situation of the intersection.

Next, the right-turn collision prevention assistance-target orientation setting routine (FIG. 3) is described. In this right-turn collision prevention assistance-target orientation setting routine, the same step number is given to the same processing as that in the head-on collision prevention assistance-target orientation setting routine described above and the description thereof is omitted.

The processing of the assistance-target orientation setting unit 17 proceeds to step S21 if at least one of the following four conditions is satisfied: there is a preceding vehicle (S10), the host vehicle is traveling outside a road (S12), the target intersection is grade separated (S14), and there is a median strip in the target intersection (S16). In step S21, the assistance-target orientation setting unit 17 excludes the forward orientation from the assistance-target orientations. After performing the processing in step S21, the assistance-target orientation setting unit 17 once terminates this routine.

If none of these four conditions is satisfied, the assistance-target orientation setting unit 17 determines in step S22 whether the right blinker is on. In this case, the assistance-target orientation setting unit 17 reads the blinker information, which indicates the blinker activation state acquired by the host vehicle information acquisition unit 12, to determine whether the right blinker is on. If none of the above four conditions is satisfied when the driver is going to turn the host vehicle to the right, there is a need to make the driver pay attention to the on-coming vehicle that is traveling straight ahead from in front the host vehicle toward the intersection.

Therefore, if the right blinker is on, the processing of the assistance-target orientation setting unit 17 proceeds to step S23, sets the forward orientation as the assistance-target orientation and once terminates this routine. On the other hand, if the right blinker is not on, the assistance-target orientation setting unit 17 performs the processing in step S21 and once terminates this routine. Therefore, the forward orientation is excluded from the assistance-target orientations.

The assistance-target orientation setting unit 17 repeats this routine at predetermined periodic calculation intervals to set the assistance-target orientations for preventing a right-turn collision according to the situation of the intersection. The vehicle alert apparatus in this embodiment is applied to a left-hand traffic vehicle. When applying the vehicle alert apparatus to a right-hand traffic vehicle, the assistance-target orientation setting unit 17 determines whether the left blinker is on. In this case, when reading the description relating to the activation of the blinker in this specification, "right" should be replaced with "left". That is, the blinker (right or left) the activation state of which is determined in step S22 is the blinker corresponding to the direction in which the host vehicle is going to cross the oncoming lane.

The assistance-target orientation setting unit 17 sets the sum of the assistance-target orientations set by the head-on collision prevention assistance-target orientation setting routine and the assistance-target orientations set by the right-turn collision prevention assistance-target orientation setting routine as the final assistance-target orientations. For example, when the assistance-target orientation set by the head-on collision prevention assistance-target orientation setting routine is the rightward orientation and the assistance-target orientation set by the right-turn collision prevention assistance-target orientation setting routine is the forward orientation, the final assistance-target orientations are the rightward orientation and the forward orientation.

The assistance-target orientation setting unit 17 supplies the assistance-target orientations, which have been set, to the alert determination unit 18. As described above, if the target vehicle selected by the target vehicle selection unit 14 is present in the assistance-target orientations set by the assistance-target orientation setting unit 17, the alert determination unit 18 determines that there is a need to alert the driver to the target vehicle. If the alert determination unit 18 determines that there is a need to alert the driver to the target vehicle, the presentation image selection unit 19 selects a presentation image according to the assistance-target orientation in which the target vehicle is located. As a result, the alert output unit 20 displays the presentation image, selected by the presentation image selection unit 19, on the display 37.

Therefore, the assistance-target orientation setting unit 17 narrows down the assistance-target orientations according to the situation of the intersection and the activation condition of the right blinker to reduce unnecessary alerts.

When both the condition for displaying the head-on collision alert image and the condition for displaying the right-turn collision alert image are satisfied, the presentation image selection unit 19 selects the head-on collision alert image with priority on the prevention of the head-on collision that is more dangerous.

Figure 10:
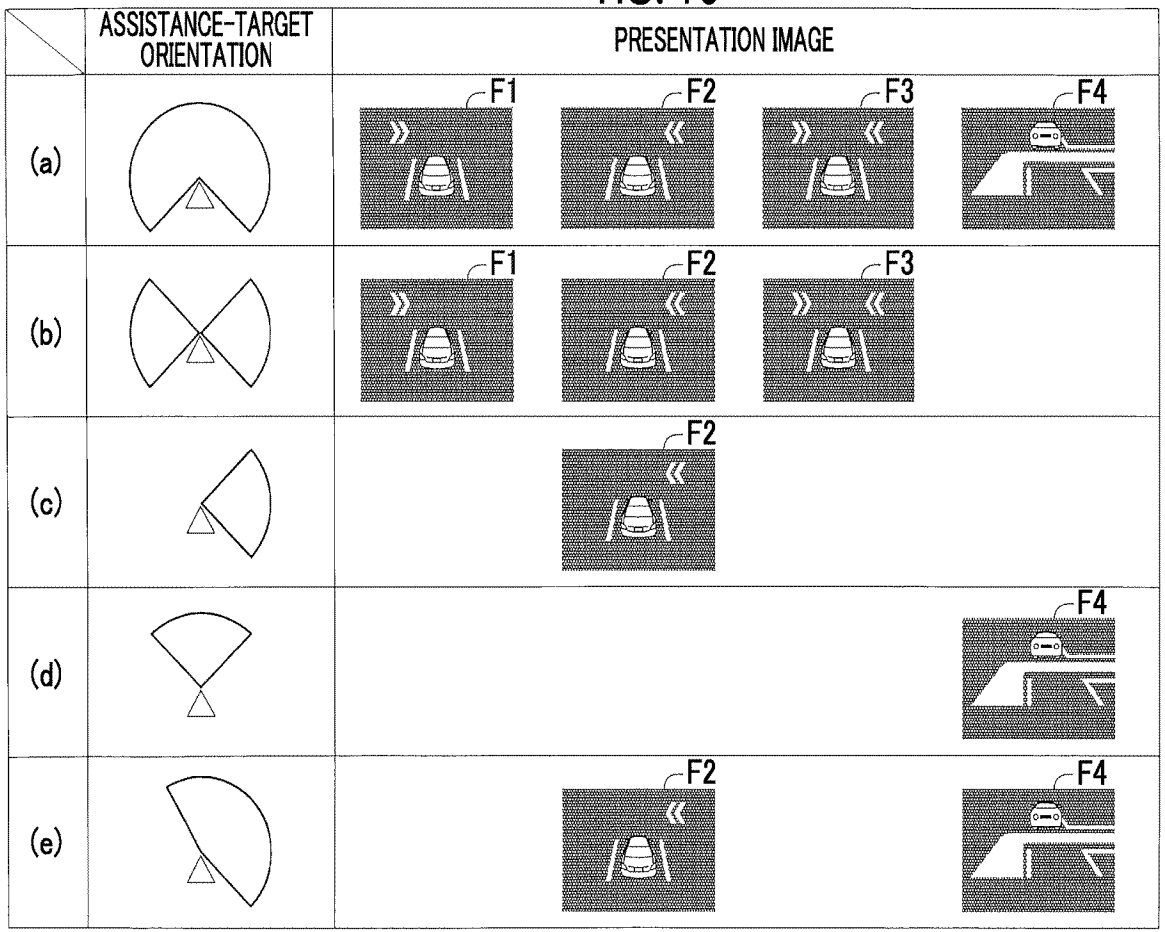
FIG. 10 is a diagram showing the relation between assistance-target orientations and presentation images.

For example, column (a) of FIG. 10 shows that the forward orientation, the leftward orientation, and the rightward orientation are set as the assistance-target orientations. In this case, the head-on collision alert image F1 is displayed when the target vehicle is present in the leftward orientation, the head-on collision alert image F2 is displayed when the target vehicle is present in the rightward orientation, the head-on collision alert image F3 is displayed when the target vehicles are present in the leftward orientation and the rightward direction, and the right-turn collision alert image F4 is displayed when the target vehicle is present in the forward orientation. When the target vehicle is present in the forward orientation but the other target vehicle is present in at least one of the leftward orientation and the rightward orientation, one of the head-on collision alert images F1, F2, and F3 is displayed as appropriate.

Column (b) of FIG. 10 shows that the leftward orientation and the rightward orientation are set as the assistance-target orientations (the forward orientation is excluded). In this case, the head-on collision alert image F1 is displayed when the target vehicle is present in the leftward orientation, the head-on collision alert image F2 is displayed when the target vehicle is present in the rightward orientation, and the head-on collision alert image F3 is displayed when the target vehicles are present in the leftward orientation and the rightward direction. In this situation, the right-turn collision alert image F4 is not displayed even when the target vehicle is present in the forward orientation.

Column (c) of FIG. 10 shows that the rightward orientation is set as the assistance-target orientation (the leftward orientation and the forward orientation are excluded). In this case, the head-on collision alert image F2 is displayed only when the target vehicle is present in the rightward orientation. None of the head-on collision alert images F1 and F3 and the right-turn collision alert image F4 is displayed even when the target vehicle is present in any of the orientations other than the rightward orientation.

Column (d) of FIG. 10 shows that the forward orientation is set as the assistance-target orientation (the leftward orientation and the rightward orientation are excluded). In this case, the right-turn collision alert image F4 is displayed only when the target vehicle is present in the forward orientation. None of the head-on collision alert images F1, F2, and F3 is displayed even when the target vehicle is present in any of the orientations other than the forward orientation.

Column (e) of FIG. 10 shows that the forward orientation and the rightward orientation are set as the assistance-target orientations (the leftward orientation is excluded). In this case, the head-on collision alert image F2 is displayed when the target vehicle is present in the rightward orientation and the right-turn collision alert image F4 is displayed when the target vehicles is present in the forward orientation. In addition, the head-on collision alert image F2 is displayed preferentially when the target vehicles are present in the rightward orientation and the forward orientation. In this situation, none of the head-on collision alert images F1 and F3 is displayed even when the target vehicle is present in the left orientation.

The vehicle alert apparatus 1 in the embodiment described above sets the assistance-target orientations based on the intersection information indicating the situation of the intersection where the host vehicle is going to enter (including a location where the roads are grade separated). In other words, the vehicle alert apparatus 1 sets the assistance-target orientations from which the following two types of orientation are excluded according to the situation: one is the orientation in which it is estimated that another vehicle cannot collide with the host vehicle based on the intersection information and the other is the orientation in which it is estimated that another vehicle will not collide with the host vehicle for regulatory reasons based on the intersection information. If the target vehicle is not present in any of the assistance-target orientations that are set, an alert to the driver for the target vehicle is inhibited. In other words, if the target vehicle is approaching the host vehicle from the orientation in which it is estimated that the target vehicle cannot collide with the host vehicle based on the intersection information or if the target vehicle is approaching the host vehicle from the orientation in which it is estimated that the target vehicle will not collide with the host vehicle for regulatory reasons based on the intersection information, an alert to the driver for the target vehicle is inhibited. Therefore, if the target vehicle is approaching the host vehicle but if it is estimated that the target vehicle will not actually collide with the host vehicle, an alert to the driver is not given. This reduces the frequency with which unnecessary alerts are given. As a result, this prevents the driver from feeling annoyed and, in addition, improves the reliability of the vehicle alert apparatus.

Figure 11:
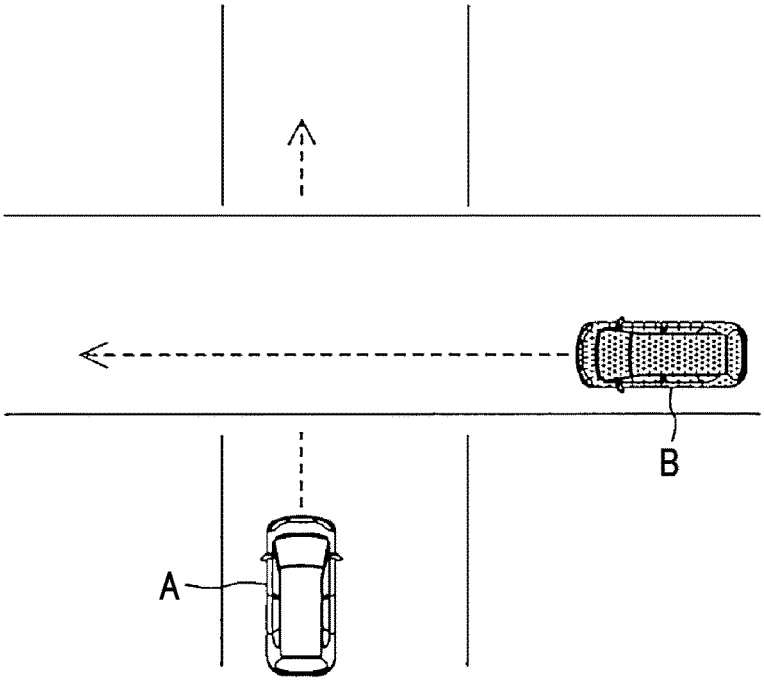
FIG. 11 RELATED ART
FIG. 11 is a diagram showing a situation in which an unnecessary alert is given at a grade separated intersection.

For example, when the traveling road of the host vehicle A and another road are grade separated as shown in FIG. 11, the host vehicle A cannot collide with the other vehicle B traveling on the road that is grade separated from the traveling road of the host vehicle A. Under such circumstances, the conventional apparatus gives an alert to the driver as the other vehicle B is approaching. On the other hand, in this embodiment, an alert to the driver is not given even when the other vehicle B is approaching the host vehicle A since all orientations are excluded from the assistance-target orientations. This makes it possible to prevent the driver from feeling annoyed.

Figure 12:
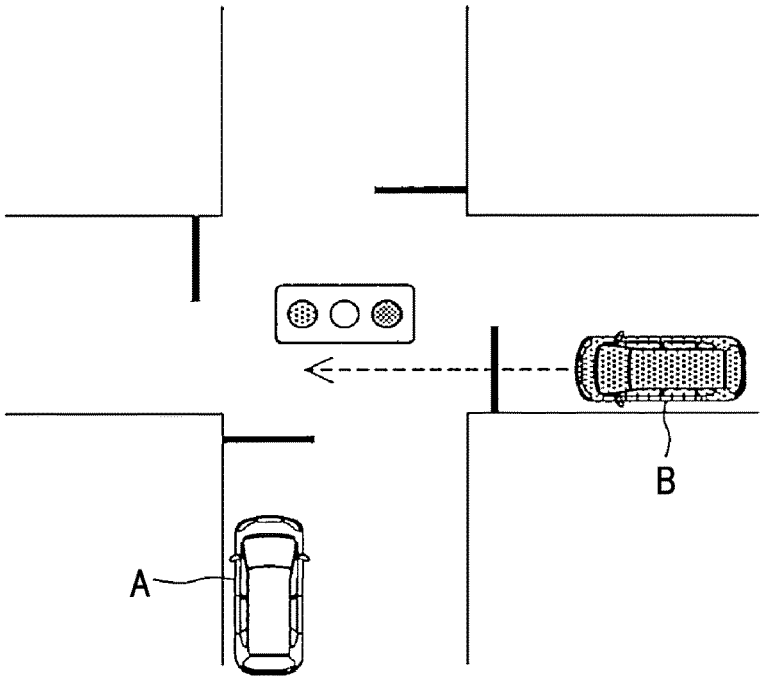
FIG. 12 is a diagram showing a situation in which an unnecessary alert is given at an intersection where a traffic light is installed.

In addition, when the host vehicle A is waiting for the traffic light at an intersection as shown in FIG. 12, the host vehicle A will not collide with another vehicle B that is going to enter the intersection from another road. Under such circumstances, the conventional apparatus gives an alert to the driver as the other vehicle B is approaching. On the other hand, in this embodiment, an alert to the driver is not given even when the other vehicle B is approaching the host vehicle A since the leftward orientation and the rightward orientation are excluded from the assistance-target orientations at an intersection where the traffic light is installed. This makes it possible to prevent the driver from feeling annoyed.

In addition, at an intersection where the median strip is installed, the orientations in which it is estimated that another vehicle cannot collide with the host vehicle are set based on the median strip direction with respect to the host vehicle. The orientations that are set are excluded from the target orientations. Excluding the orientations in this way reduces the frequency with which unnecessary alerts are given to the driver.

In addition, at an intersection where the traffic light is not installed, the leftward orientation and the rightward orientation are excluded from the assistance-target orientations when the host vehicle traveling road is the road that has priority over the other road that crosses the intersection. This reduces the frequency with which unnecessary alerts are given. In this case, since the priority of the roads is determined based on whether the stop sign is installed, the priority can be determined appropriately.

In addition, the forward orientation is excluded from the assistance-target orientations unless the on-state of the right blinker is detected. Excluding the forward direction in this way reduces the frequency with which unnecessary alerts are given while maintaining the alert function for a right-turn collision.

Although the vehicle alert apparatus in this embodiment has been described above, the present disclosure is not limited to the above embodiment and various modifications can be added without departing from the purpose of the present disclosure.

For example, in this embodiment, the following two types of orientation are excluded from the assistance-target orientations: the orientation in which it is estimated that another vehicle cannot collide with the host vehicle based on the intersection information and the orientations in which it is estimated that another vehicle will not collide with the host vehicle for regulatory reasons based on the intersection information. Instead, it is also possible to exclude only one of two types of orientation (either the orientation in which it is estimated that another vehicle cannot collide with the host vehicle based on the intersection information or the orientation in which it is estimated that another vehicle will not collide with the host vehicle for regulatory reasons based on the intersection information). For example, the orientation according to each of the cases given below may be excluded from the assistance-target orientations: the case in which it is estimated that the target intersection is a grade separated intersection (case 1), the case in which it is estimated that the median strip is installed at the target intersection (case 2), the case in which it is estimated that the traffic light is installed at the target intersection (case 3), and the case in which it is estimated that the stop sign is not installed at the target intersection (case 4). Instead, two or more of the cases 1 to 4 may be arbitrarily combined and, if any one of the cases is detected, the orientation corresponding to the detected case may be excluded from the assistance-target orientations.

Although the forward orientation is set as the assistance-target orientation in this embodiment based on whether the right blinker is on, this configuration is not necessarily required.

Although the target vehicle that may collide with the host vehicle is set based on the collision prediction time in this embodiment, the target vehicle is not necessarily set based on the collision prediction time. For example, another vehicle may be set as the target vehicle based on the distance between the host vehicle and the other vehicle that is approaching. That is, the other vehicle may be set as the target vehicle if the distance is equal to or smaller than the threshold.

What is claimed is:

1. A vehicle alert method comprising:

carrying out vehicle-vehicle communication with another vehicle around a host vehicle to determine an approaching state between the host vehicle and the other vehicle when the host vehicle is going to enter an intersection and, based on the approaching state, detecting another vehicle that may collide with the host vehicle as an alert target vehicle;

operating an alert unit to make a driver pay attention to the target vehicle when the target vehicle is detected;

acquiring intersection information that represents a situation of the intersection where the host vehicle is going to enter;

inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information;

acquiring, as the intersection information, the intersection information that represents a situation of the intersection including a grade separated location where the host vehicle traveling road and another road are grade separated and that can be used to estimate whether the intersection is the grade separated location; and determining that each of a leftward orientation and a rightward orientation of the host vehicle is an orientation in which the target vehicle cannot collide with the host vehicle and inhibiting the operation of the alert unit for the target vehicle that is approaching the host vehicle from the orientation in which it is determined that the target vehicle cannot collide with the host vehicle, if it is estimated that the intersection is the grade separated location.

2. A vehicle alert method comprising:

carrying out vehicle-vehicle communication with another vehicle around a host vehicle to determine an approaching state between the host vehicle and the other vehicle when the host vehicle is going to enter an intersection and, based on the approaching state, detecting another vehicle that may collide with the host vehicle as an alert target vehicle;

operating an alert unit to make a driver pay attention to the target vehicle when the target vehicle is detected;

acquiring intersection information that represents a situation of the intersection where the host vehicle is going to enter;

inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information;

acquiring, as the intersection information, information that can be used to estimate a presence or absence of a median strip in the intersection; and setting the orientation in which it is estimated that the target vehicle cannot collide with the host vehicle based on a median strip direction with respect to the host vehicle and inhibiting the operation of the alert unit for the target vehicle that is approaching the host vehicle from the set orientation, if it is estimated that the median strip is provided in the intersection.

3. A vehicle alert method comprising:

carrying out vehicle-vehicle communication with another vehicle around a host vehicle to determine an approaching state between the host vehicle and the other vehicle when the host vehicle is going to enter an intersection and, based on the approaching state, detecting another vehicle that may collide with the host vehicle as an alert target vehicle;

operating an alert unit to make a driver pay attention to the target vehicle when the target vehicle is detected;

acquiring intersection information that represents a situation of the intersection where the host vehicle is going to enter;

inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information;

acquiring, as the intersection information, information that can be used to estimate whether a traffic light is installed at the intersection; and determining that each of a leftward orientation and a rightward orientation of the host vehicle is an orientation in which it is estimated that the target vehicle will not collide with the host vehicle for regulatory reasons and inhibiting the operation of the alert unit for the target vehicle that is approaching the host vehicle from the orientation in which it is estimated that the target vehicle will not collide with the host vehicle, if it is estimated that the traffic light is installed at the intersection.

4. A vehicle alert method comprising:

carrying out vehicle-vehicle communication with another vehicle around a host vehicle to determine an approaching state between the host vehicle and the other vehicle when the host vehicle is going to enter an intersection and, based on the approaching state, detecting another vehicle that may collide with the host vehicle as an alert target vehicle;

operating an alert unit to make a driver pay attention to the target vehicle when the target vehicle is detected;

acquiring intersection information that represents a situation of the intersection where the host vehicle is going to enter;

inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information;

acquiring, as the intersection information, information that can be used to estimate a priority relation between roads crossing the intersection; and determining that each of a leftward orientation and a rightward orientation of the host vehicle is an orientation in which it is estimated that the target vehicle will not collide with the host vehicle for regulatory reasons and inhibiting the operation of the alert unit for the target vehicle that is approaching the host vehicle from the orientation in which it is estimated that the target vehicle will not collide with the host vehicle, if it is estimated that the road crossing the intersection has not priority over the host vehicle traveling road.

5. The vehicle alert method according to claim 4, further comprising:

acquiring, as the intersection information, information that can be used to estimate whether a stop sign for the host vehicle traveling road is installed at a position where the host vehicle traveling road is connected to the intersection; and determining that each of the leftward orientation and the rightward orientation of the host vehicle is the orientation in which it is estimated that the target vehicle will not collide with the host vehicle for regulatory reasons and inhibiting the operation of the alert unit for the target vehicle that is approaching the host vehicle from the orientation in which it is estimated that the target vehicle will not collide with the host vehicle, if it is estimated that the stop sign is not installed at the position.

6. A vehicle alert method comprising:

carrying out vehicle-vehicle communication with another vehicle around a host vehicle to determine an approaching state between the host vehicle and the other vehicle when the host vehicle is going to enter an intersection and, based on the approaching state, detecting another vehicle that may collide with the host vehicle as an alert target vehicle;

operating an alert unit to make a driver pay attention to the target vehicle when the target vehicle is detected;

acquiring intersection information that represents a situation of the intersection where the host vehicle is going to enter;

inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information;

detecting an activation state of a blinker of the host vehicle; and inhibiting the operation of the alert unit for the target vehicle that is approaching from a forward direction to the host vehicle unless the blinker detection unit detects that the blinker indicates a direction crossing an oncoming lane.

7. A vehicle alert method comprising:

carrying out vehicle-vehicle communication with another vehicle around a host vehicle to determine an approaching state between the host vehicle and the other vehicle when the host vehicle is going to enter an intersection and, based on the approaching state, detecting another vehicle that may collide with the host vehicle as an alert target vehicle;

operating an alert unit to make a driver pay attention to the target vehicle when the target vehicle is detected;

acquiring intersection information that represents a situation of the intersection where the host vehicle is going to enter;

inhibiting an operation of the alert unit for the target vehicle in at least one of a case in which the target vehicle is approaching the host vehicle from an orientation in which it is estimated that the target vehicle cannot collide with the host vehicle based on the intersection information or a case in which the target vehicle is approaching the host vehicle from an orientation in which it is estimated that the target vehicle will not collide with the host vehicle for regulatory reasons based on the intersection information;

narrowing down an assistance-target orientations by excluding at least one of an orientation of the other vehicle, in which it is estimated that the other vehicle cannot collide with the host vehicle based on the intersection information, or an orientation of the other vehicle, in which it is estimated that the other vehicle will not collide with the host vehicle for regulatory reasons based on the intersection information, from assistance-target orientations in which an alert is to be given; and inhibiting the operation of the alert unit for the target vehicle when the target vehicle detected is not present in the assistance-target orientation narrowed down.

8. The vehicle alert method according to claim 7, further comprising:

acquiring, as the intersection information, intersection information that represents a situation of the intersection including a grade separated location where the host vehicle traveling road and another road are grade separated and that can be used to estimate whether the intersection is the grade separated location; and excluding a leftward orientation and a rightward orientation, in which it is estimated that the other vehicle cannot collide with the host vehicle, from the assistance-target orientations if it is estimated that the intersection is the grade separated location.

9. The vehicle alert method according to claim 7, further comprising:

acquiring, as the intersection information, information that can be used to estimate a presence or absence of a median strip in the intersection; and setting the orientation of the other vehicle in which it is estimated that the other vehicle cannot collide with the host vehicle based on a median strip direction with respect to the host vehicle and to exclude the set orientation from the assistance-target orientations, if it is estimated that the median strip is provided in the intersection.

10. The vehicle alert method according to claim 7, further comprising:

acquiring, as the intersection information, information that can be used to estimate whether a traffic light is installed at the intersection; and excluding a leftward orientation and a rightward orientation, in which it is estimated that the other vehicle will not collide with the host vehicle for regulatory reasons, from the assistance-target orientations if it is estimated that the traffic light is installed at the intersection.

11. The vehicle alert method according to claim 7, further comprising:

acquiring, as the intersection information, information that can be used to estimate a priority relation between roads crossing the intersection; and excluding a leftward orientation and a rightward orientation, in which it is estimated that the other vehicle will not collide with the host vehicle for regulatory reasons, from the assistance-target orientations if the host vehicle traveling road has priority over the other road crossing the intersection.

12. The vehicle alert method according to claim 11, further comprising:

acquiring, as the intersection information, information that can be used to estimate whether a stop sign is installed at a position where the host vehicle traveling road is connected to the intersection; and excluding the leftward orientation and the rightward orientation, in which it is estimated that the other vehicle will not collide with the host vehicle for regulatory reasons, from the assistance-target orientations if it is estimated that the stop sign is not installed at the position.

13. The vehicle alert method according to claim 7, further comprising:

detecting an activation state of a blinker of the host vehicle;

excluding a forward orientation of the host vehicle from the assistance-target orientations unless the blinker detection unit detects that the blinker indicates a direction crossing an oncoming lane; and inhibiting the operation of the alert unit for the target vehicle when the target vehicle detected is present in the forward orientation that has been excluded.

* * * * *